US005141470A

United States Patent [19]

Morgan et al.

[11] Patent Number: 5,141,470

[45] Date of Patent: Aug. 25, 1992

[54] MONOCOQUE BREAST SUPPORTING FRAMES

[75] Inventors: Harvey S. Morgan, Woodmere; Joseph Horta, Yonkers; Vito F. Christiano, Portchester, all of N.Y.

[73] Assignee: S&S Industries, Inc., New York, N.Y.

[21] Appl. No.: 762,878

[22] Filed: Sep. 19, 1991

[51] Int. Cl.[5] ..... A41C 1/14; A41C 1/16

[52] U.S. Cl. ..... 450/52; 450/41

[58] Field of Search ..... 450/41, 42, 43, 44, 450/45, 46, 47, 48, 49, 50, 51, 52

[56] References Cited

U.S. PATENT DOCUMENTS

| | | | |
|---|---|---|---|
| 2,608,689 | 9/1952 | Van Leuven, Jr. | 450/53 X |
| 2,705,800 | 4/1955 | Schwartz | 450/52 |
| 2,782,417 | 2/1957 | Magidson | 450/41 |
| 2,923,300 | 2/1960 | Ots | 450/45 |
| 3,114,374 | 12/1963 | Chalfin et al. | 450/41 |
| 3,209,756 | 10/1965 | Rowell | 450/52 |
| 3,605,753 | 9/1971 | Schwartz | 450/52 |
| 4,235,240 | 11/1980 | Cousins | 450/52 |
| 4,558,705 | 12/1985 | O'Boyle et al. | 450/52 |

FOREIGN PATENT DOCUMENTS

| | | | |
|---|---|---|---|
| 608078 | 11/1960 | Canada | 450/45 |
| 1161657 | 9/1958 | France | 450/41 |
| 1416895 | 9/1965 | France | 450/41 |

*Primary Examiner*—Werner H. Schroeder
*Assistant Examiner*—Jeanette E. Chapman
*Attorney, Agent, or Firm*—Abelman Frayne & Schwab

[57] ABSTRACT

A monocoque breast supporting frame including a reduced mass arcuate shaped resilient wire and a specifically formulated reinforcing sleeve-like, low friction member totally encasing the wire; said sleeve-like number having a plurality of circumferential radii, thickness, and structural integrity specifically disposed along the arcuate shaped, reduced mass, resilient wire to afford maximum strength and resilience to the frame and maximum comfort to the wearer.

4 Claims, 1 Drawing Sheet

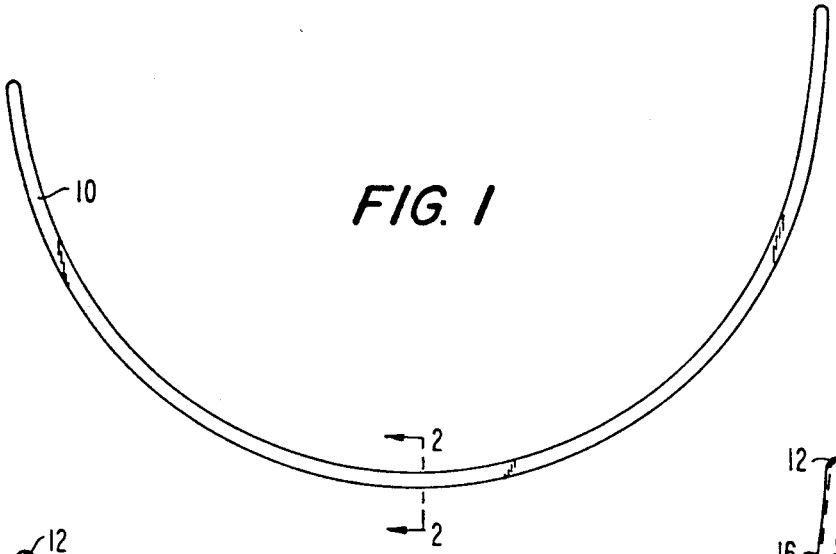
FIG. 1
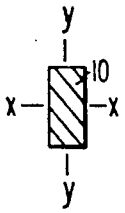
FIG. 2
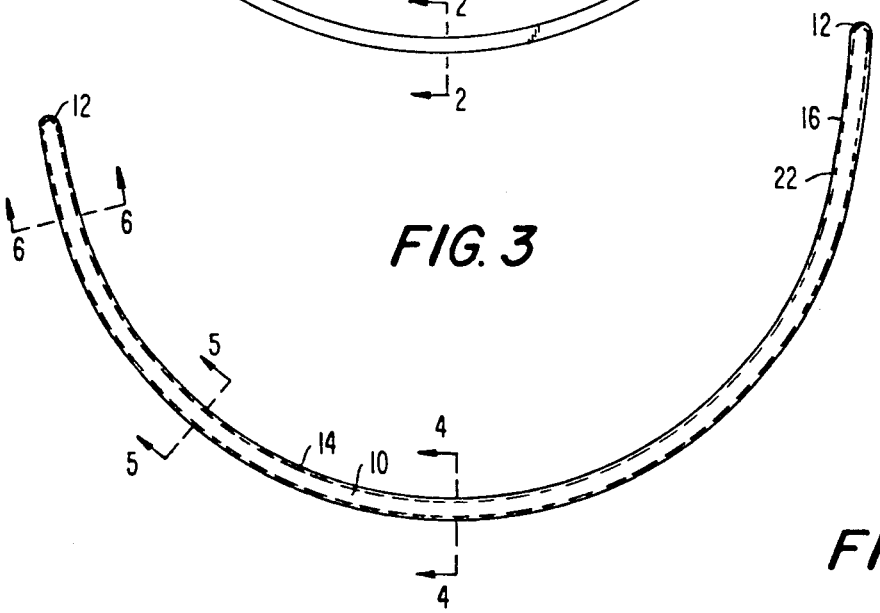
FIG. 3
FIG. 4
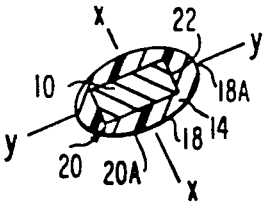
FIG. 5
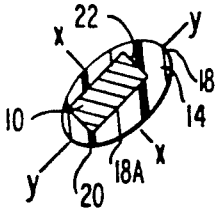
FIG. 6
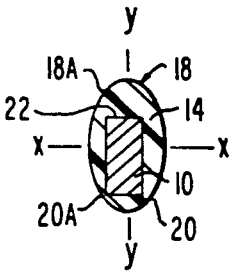

MONOCOQUE BREAST SUPPORTING FRAMES

BACKGROUND OF THE INVENTION

This invention relates to an improved breast supporting frame for use in brassieres or other similarly related foundation garments.

DESCRIPTION OF THE PRIOR ART

Heretofore, it has been proposed to provide brassieres having a pair of spaced breast receiving cups or pockets with arcuate, generally U-shaped supporting frames which extend along the side and bottom peripheral portions of the cups. The use of such supporting frames, that form the stiffening members for the breast cups and their surrounding panel portions, serves to keep the shape of that portion of the brassiere engaging with and containing the breast cups. The supporting frames further serve the purpose of supporting the brassiere to the bust of the wearer, and maintaining the wearer's breasts firmly in the breast cups of the brassiere so as to minimize displacement of the breasts from the breast cups.

Originally, the supporting frames were formed of wire having a round cross-section. However, it was found that if the round cross-section was of suitable diameter to sufficiently resist relative movement of the ends of the frame toward and away from each other and thus provide adequate support, the resistance to flexing of the arcuate frame out of its normal flat plane so as to conform to the contours of the weaver's body was too great, and hence resulted in discomfort to the wearer.

Accordingly, it was proposed in U.S. Pat. Nos. 2,705,800 and 2,746,052 form each brassiere frame with a substantially rectangular cross-section having its longer dimension extending radially with respect to the curvature of the frame and thereby having a far greater degree of lateral flexibility than a round wire of the same cross-sectional area, while presenting at least as much resistance to movement of the ends of the frame toward and away from each other as such round wire of equal cross-sectional area.

The utilization of the aforesaid breast frames in brassieres and other garments affords the basis for a proper supporting structure in such garments. However, certainly at least with respect to brassieres, it has been found that in order for the breast supporting frames to satisfactorily perform their intended function, they must be located and positioned in tight abutment with the body of the wearer thereby creating a high degree of discomfort to the wearer. For example, even in the case of support wire frames having a rectangular cross-section, the construction of which to a certain extent reduced some of the discomfort to the wearer, it was found that the longitudinal tension pull on the breast frame resulting from the physical movement of the wearer effected a twisting to the frame in a lateral direction which resulted in the sharp edges or corners thereof being brought into increasing pressure engagement with the body of the wearer.

Further efforts were made to reduce the aforesaid discomfort to the wearer, such as by embodying the wire support frame in a suitable coating of predetermined thickness and viscosity; said encasement defining a sleeve-like member of round cross-section which sought to prevent the sharp edges of corners on the breast frame from causing said increased pressure and discomfort to the wearer.

In this connection, specific reference is made to U.S. Pat. No. 3,209,756 which is directed to providing the aforesaid encasement for the breast support frame. Although the invention embodied in U.S. Pat. No. 3,209,756 reduced some of the difficulties heretofore described in connection with breast support frames, it was found that the encasement provided for by that patent, being of particular arcuate cross-section, did not give an optimum distribution of the encasement material with respect to the wire support frame.

Further efforts were made to reduce the aforesaid discomfort to the wearer, such as by distribution of the major portion of the encasement material disposed along the concave edge portion of the support frame. In this connection, specific reference is made to U.S. Pat. No. 3,605,753. Although the invention embodied in that patent reduced some difficulties, it was found that the encasement provided herein by disposing a pear shape cross section with the bulbous portion in the center section and progressively decreasing in cross section from the mid-section of the wire stiffening member toward the opposite ends thereof did not give an optimum distribution of the encasement material with respect to the wire support frame resulting in the edges or corners thereof being brought into increased pressure engagement with the body of the wearer creating discomfort to the wearer.

None of the above mentioned patents use this encasement material to increase the strength of the resilient member.

Thus, it was found that with a specifically formulated reinforcing, low friction, sleeve-like member totally encasing the wire and having a plurality of circumferential radii and thickness specifically disposed along the arcuate shaped resilient wire frame, the discomfort to the user due to the aforesaid increased pressure engagement with side portions of the breast is substantially reduced.

SUMMARY OF THE INVENTION

The monocoque breast supporting frame of the present invention includes an arcuate shaped reduced mass resilient wire, representing a stiffening member, preferably having a rectangular cross-section. A specifically formulated reinforcing sleeve-like member of co-polymeric material is provided which encases the wire stiffening member for the entire longitudinal extent thereof and is formulated such that said co-polymeric material affords structural integrity to the frame wire. A preferred material is comprised of fiberglass reinforcing strands, and a material having a very low surface friction which will allow the wire stiffening member assembly to move freely in the channelling provided in the garment.

The sleeve-like member is formed for it to have a multi radii cross section thus defining a bulbous portion and a tapered portion, with the bulbous portion extending along the concave edge of the wire stiffening member and projecting radially inwardly thereof.

The present invention further provides for the bulbous portion of the specifically formulated reinforced sleeve-like member to progressively increase in cross section from the mid-section of the wire stiffening member towards the opposite ends thereof.

Accordingly, it is apparent from the aforesaid summary, that an object of the present invention is to provide a combined encasement and support media for the supporting frame that is of such cross section as to result pressure distribution along the length of the frame.

A further object and feature of the present invention is to provide an improved breast support frame that is relatively simple in construction and inexpensive to manufacture, despite the complexity of its design.

DESCRIPTION OF THE DRAWINGS

The above and other features and advantages of the invention will be apparent from the following detailed description when taken in conjunction with the accompanying drawings, in which;

FIG. 1 is a front elevation of the supporting wire;

FIG. 2 is a cross-section taken on the line 2—2 of FIG. 1;

FIG. 3 is a front elevation of the composite wire; and

FIGS. 4, 5 and 6 are each sectional views taken respectively on the lines 4—4, 5—5 and 6—6 of FIG. 3.

DESCRIPTION OF THE PREFERRED EMBODIMENT

Referring to the drawings, particularly FIGS. 1 and 2. numeral 10 represents an arcuate generally U-shaped reduced mass resilient wire breast frame that provides a stiffening member for the breast cups of a brassiere. The use of such stiffening members and the manner in which they are assembled in a brassiere garment are well known in the art. In the preferred embodiment, it is proposed to construct stiffening member 10 of resilient metal material having a reduced rectangular cross-section, as shown in FIG. 2, with the longer dimension of such cross-section extending radially of the curvature of the frame. However, it is readily apparent that other frames may be used, for example, ones formed of a resilient, relatively rigid plastic and which have circular or other cross-sectional shapes.

Accordingly, the specific substance used to construct stiffening member 10 and the preferred rectangular cross-sectional shape thereof are not to be deemed limitations on the present invention.

Referring now to FIGS. 3 through 6 of the drawings, the stiffening member 10 is provided with an aforesaid specifically formulated reinforcing sleevelike member 14, defining an encasement/support for said stiffening member 10. Elements 10, and 14 and tips 12 constitute, in combination, the monocoque breast frame of the present invention designated generally by the numeral 16.

Sleeve-like member 14 is preferably constructed of a copolymeric material such as nylon, polyethylene or polyester which encases the entire stiffening member 10 along the longitudinal extent thereof.

This can be accomplished by immersion, partial immersion, dipping, spraying or molding operations, or by other techniques more fully disclosed in U.S. Pat. No. 3,209,756.

The thus coated stiffening member is then subjected to suitable heat treatment in an oven, within which the stiffening member is rotated in a selective manner to achieve the desired cross-sectional shape thereof.

Upon completion of the heat treatment process, the breast frames are then removed from the oven for other necessary operations, as more fully described in said patent. The encasement is formed to have a multi-radii cross section including a bulbous portion 18 having an arcuate surface 18A and a tapered portion 20 extending from the bulbous portion and having an arcuate surface 20A which merges with arcuate surface 18A. The construction is such that bulbous portion 18 extends radially inwardly of the concave edge of stiffening member 10.

The radial and transverse dimensions, in cross section, of bulbous portion 18 are much greater than the corresponding radial and transverse dimensions of tapered portion 20, more particularly at the end portions of the breast frame 16, and at the portion adjacent thereto as generally indicated in FIGS. 5 and 6.

The cross section of the sleeve-like member 14 is disposed relative to encased stiffening member 10 so as to make cross section of sleevelike member 14 asymmetrical with respect to stiffening member 10.

The present invention further provides that the radially projecting bulbous portion 18 progressively increases in cross section, in the radial and transverse dimension thereof, from said mid-section of breast frame 16 towards the opposite terminal ends of the frame 16.

It follows that a maximum cross section of bulbous portion 18, as indicated in FIG. 6, is located at the point of greatest relative pressure such as is developed at the edges or corners of the frame.

The configuration of the finished frame will now be described in terms of the geometry of the frame, as related to the drawings.

The stiffening member 10 is of arcuate form, the central longitudinal axis of the stiffening member, in an unstressed condition of the frame lying substantially in a single plane, that plane being the plane of the paper in FIGS. 1 and 3.

The stiffening member 10 is substantially rectangular in transverse cross-section, thus to define a major axis y—y extending in the direction of the major sides of the rectangle, and a minor axis x—x extending in the direction of the minor sides of the rectangle.

While the longitudinal axis of the stiffening member lies in the general plane of the paper throughout its length, successive transverse cross-sections through the stiffening member taken at spaced positions longitudinally of the stiffening member rotate about the longitudinal axis of the stiffening member, as will be more clearly apparent from a consideration of FIGS. 4, 5 and 6, which respectively show the transverse cross-section at the center of the frame (FIG. 4), the transverse cross-section at a position intermediate the center of the frame and the ends thereof (FIG. 5), and, the transverse cross-section of the frame at the end of the frame (FIG. 6).

Throughout its length, the stiffening member 10 is encased in polymeric material 14, which has been applied to the stiffening member in the manner described above.

At the ends of the frame, and as is illustrated in FIG. 6, the major axis of the stiffening member extends substantially perpendicular to the plane of the paper. The major axis y—y at cross-sections of the stiffening member intermediate the opposite ends of the frame wire have been progressively rotated out of the plane of the paper as illustrated in FIG. 5, to a central position of the stiffening member at which the major axis extends at a minimum angle transverse to the plane of the paper, as is illustrated in FIG. 4.

The encasement of polymeric material, at all transverse sections of the stiffening member 10, includes an upwardly extending bulbous portion 18, which extends to one side of the plane at the paper, and a downwardly extending tapered portion 20 which extends to the opposite side of the plane of the paper.

As will be observed from FIGS. 4, 5 and 6, the bulbous portion 18 progressively increases in transverse cross-section from the central portion of the stiffening member, as illustrated in FIG. 4, to each of the end portions of the stiffening member, as illustrated in FIG. 6.

While a specific embodiment of the invention has been shown and described in detail, it will be readily understood and appreciated that various changes or modifications thereof may be made without departing from the spirit and scope of the invention as set forth in the appended claims.

What is claimed is:

1. In a frame for a breast cup of a brassiere, which includes a stiffening member of arcuate form, a central longitudinal axis of said stiffening member in an unstressed condition of said frame lying substantially in a single plane, said stiffening member, in all transverse cross-sections of said stiffening member defining a major axis and a minor axis, and, an encasement of a polymeric material surrounding said stiffening member throughout the arcuate extent thereof, the improvement comprising:

said major axis, at the respective opposite ends of said stiffening member extending substantially perpendicular to said plane;

said major axis, at cross-sections of said stiffening member intermediate said opposite ends, progressively being rotated out of said plane to a central position of said stiffening member at which said major axis extends at a maximum angle transverse to said plane;

said encasement of polymeric material, at all transverse sections of said stiffening member including an upwardly extending bulbous portion extending on one side of said plane, and a downwardly extending tapered portion extending on an opposite side of said plane.

2. The breast frame as recited in claim 1, further including tip members totally sealing and enclosing the ends of the stiffening member.

3. The breast frame as recited in claim 1, wherein said stiffening member is of rectangular cross section and is asymmetrically disposed relative to the cross section of the reinforcing sleeve-like member.

4. The breast frame of claim 1, in which said bulbous portion progressively increases in transverse cross-section from said central portion of said stiffening member to each said end portion of said stiffening member.

* * * * *